US011081128B2

(12) United States Patent
Saito et al.

(10) Patent No.: US 11,081,128 B2
(45) Date of Patent: Aug. 3, 2021

(54) SIGNAL PROCESSING APPARATUS AND METHOD, AND PROGRAM

(71) Applicant: Sony Corporation, Tokyo (JP)

(72) Inventors: Mari Saito, Kanagawa (JP); Hiro Iwase, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 166 days.

(21) Appl. No.: 16/485,789

(22) PCT Filed: Apr. 12, 2018

(86) PCT No.: PCT/JP2018/015355
§ 371 (c)(1),
(2) Date: Aug. 14, 2019

(87) PCT Pub. No.: WO2018/198792
PCT Pub. Date: Nov. 1, 2018

(65) Prior Publication Data

US 2020/0051586 A1 Feb. 13, 2020

(30) Foreign Application Priority Data

Apr. 26, 2017 (JP) ..... JP2017-086821

(51) Int. Cl.
*G10L 25/84* (2013.01)
*H04S 7/00* (2006.01)
*G10L 25/60* (2013.01)

(52) U.S. Cl.
CPC ..... *G10L 25/84* (2013.01); *G10L 25/60* (2013.01); *H04S 7/303* (2013.01)

(58) Field of Classification Search
CPC ..... G10K 11/1754; G10K 11/1752; G10K 2210/3046; G10L 21/06; G10L 25/00;
(Continued)

(56) References Cited

U.S. PATENT DOCUMENTS 10,074,356 B1 * 9/2018 Sarkar ..... H04R 27/00
2013/0163772 A1 * 6/2013 Kobayashi ..... G10K 11/1754 381/71.1
(Continued)

FOREIGN PATENT DOCUMENTS

JP 2007-13274 A 1/2007
JP 2008-209703 A 9/2008
(Continued)

OTHER PUBLICATIONS

Aaronson, Speech on Speech Masking in a Front back Dimension and Analysis of Binaural parameters in Rooms using MLS Methods, Michigan State University, 2008 (Year: 2008).*
(Continued)

*Primary Examiner* — Linda Wong
(74) *Attorney, Agent, or Firm* — Xsensus LLP

(57) ABSTRACT

A sound state estimating unit detects surrounding sound at a timing at which a notification to a destination user occurs. A user state estimating unit detects a position of the destination user and positions of users other than the destination user at the timing at which the notification occurs. An output control unit controls output of the notification to the destination user at a timing at which it is determined that the surrounding sound detected by the sound state estimating unit is masking possible sound which can be used for masking in a case where the position of the destination user detected by the user state estimating unit is within a predetermined area.

13 Claims, 6 Drawing Sheets

(58) Field of Classification Search
CPC ..... G10L 2021/02166; G10L 21/003; G10L 21/013; G10L 21/034; G10L 15/26; G10L 21/00
See application file for complete search history.

(56) References Cited

U.S. PATENT DOCUMENTS

| | | | | |
|---|---|---|---|---|
| 2013/0170655 | A1* | 7/2013 | Satoyoshi | H04K 3/825 381/56 |
| 2014/0086426 | A1* | 3/2014 | Yamakawa | H04K 3/84 381/73.1 |
| 2014/0122077 | A1* | 5/2014 | Nishikawa | G10L 17/00 704/249 |
| 2014/0376740 | A1* | 12/2014 | Shigenaga | G08B 13/19652 381/92 |
| 2016/0351181 | A1* | 12/2016 | Benway | H04K 3/84 |
| 2017/0076708 | A1* | 3/2017 | Benway | H04K 3/825 |
| 2018/0040338 | A1* | 2/2018 | Schiro | G10L 25/78 |
| 2018/0151168 | A1* | 5/2018 | Benway | H04R 3/12 |
| 2018/0261202 | A1* | 9/2018 | Sarkar | G10K 11/178 |

FOREIGN PATENT DOCUMENTS

| | | | |
|---|---|---|---|
| JP | 2011-33949 | A | 2/2011 |
| JP | 2015-101332 | A | 6/2015 |

OTHER PUBLICATIONS

International Search Report and Written Opinion dated Jul. 3, 2018 for PCT/JP2018/015355 filed on Apr. 12, 2018, 8 pages including English Translation of the International Search Report.

* cited by examiner

SIGNAL PROCESSING APPARATUS AND METHOD, AND PROGRAM

CROSS-REFERENCE TO RELATED APPLICATIONS

The present application is based on PCT filing PCT/JP2018/015355, filed Apr. 12, 2018, which claims priority to JP 2017-086821, filed Apr. 26, 2017, the entire contents of each are incorporated herein by reference.

TECHNICAL FIELD

The present disclosure relates to a signal processing apparatus and method, and a program, and, more particularly, to a signal processing apparatus and method, and a program which are capable of naturally creating a state in which privacy is protected.

BACKGROUND ART

In a case where there is a period during which an item should be conveyed only to a specific user from a system, in a case where a notification is made from the system in a room in which there is a plurality of persons, the item is conveyed to all the persons there, and privacy has not been protected. Further, while it is possible to allow only the specific user to listen to the item by performing output with high directionality such as BF, it is necessary to provide dedicated speakers at a number of locations to realize this.

Therefore, Patent Document 1 makes a proposal of starting operation of a masking sound generating unit which generates masking sound to make it difficult for the others to listen to conversation speech of patients when patient information is recognized.

CITATION LIST

Patent Document

Patent Document 1: Japanese Patent Application Laid-Open No. 2010-19935

SUMMARY OF THE INVENTION

Problems to be Solved by the Invention

However, with the proposal of Patent Document 1, emitting masking sound makes a state unnatural, which has inversely got the conversation speech noticed in an environment such as a living room.

The present disclosure has been made in view of such circumstances and is directed to being able to naturally create a state in which privacy is protected.

Solutions to Problems

A signal processing apparatus according to an aspect of the present disclosure includes: a sound detecting unit configured to detect surrounding sound at a timing at which a notification to a destination user occurs; a position detecting unit configured to detect a position of the destination user and positions of users other than the destination user at the timing at which the notification occurs; and an output control unit configured to control output of the notification to the destination user at a timing at which it is determined that the surrounding sound detected by the sound detecting unit is masking possible sound which can be used for masking in a case where the position of the destination user detected by the position detecting unit is within a predetermined area.

A movement detecting unit configured to detect movement of the destination user and the users other than the destination user is further included, and in a case where movement is detected by the movement detecting unit, the position detecting unit also detects a position of the destination user and positions of the users other than the destination user to be estimated through movement detected by the movement detecting unit.

A duration predicting unit configured to predict a duration while the masking possible sound continues is further included, and the output control unit may control output of information indicating that the duration while the masking possible sound continues, predicted by the duration predicting unit, ends.

The surrounding sound is stationary sound emitted from equipment in a room, sound non-periodically emitted from equipment in the room, speech emitted from a person or an animal, or environmental sound entering from outside of the room.

In a case where it is determined that the surrounding sound detected by the sound detecting unit is not masking possible sound which can be used for masking, in a case where the position of the destination user detected by the position detecting unit is within the predetermined area, the output control unit controls output of the notification to the destination user along with sound in a frequency band which can be heard only by the users other than the destination user.

The output control unit may control output of the notification to the destination user with sound quality which is similar to sound quality of the surrounding sound detected by the sound detecting unit.

The output control unit may control output of the notification to the destination user in a case where the positions of the users other than the destination user detected by the position detecting unit are not within the predetermined area.

The output control unit may control output of the notification to the destination user in a case where it is detected that the users other than the destination user detected by the position detecting unit are put into a sleep state.

The output control unit may control output of the notification to the destination user in a case where the users other than the destination user detected by the position detecting unit focus on a predetermined thing.

The predetermined area is an area where the destination user often exists.

In a case where it is not determined that the surrounding sound detected by the sound detecting unit is masking possible sound which can be used for masking, or in a case where the position of the destination user detected by the position detecting unit is not within the predetermined area, the output control unit may notify the destination user that there is a notification.

A feedback unit configured to give feedback that the notification to the destination user has been made to an issuer of the notification to the destination user may further be included.

In a signal processing method according to an aspect of the present technology, a signal processing apparatus detects surrounding sound at a timing at which a notification to a destination user occurs; detects a position of the destination user and positions of users other than the destination user at the timing at which the notification occurs; and controls output of the notification to the destination user at a timing at which it is determined that the surrounding sound detected is masking possible sound which can be used for masking in a case where the position of the destination user detected is within a predetermined area.

A program according to an aspect of the present technology for causing a computer to function as: a sound detecting unit configured to detect surrounding sound at a timing at which a notification to a destination user occurs; a position detecting unit configured to detect a position of the destination user and positions of users other than the destination user at the timing at which the notification occurs; and an output control unit configured to control output of the notification to the destination user at a timing at which it is determined that the surrounding sound detected by the sound detecting unit is masking possible sound which can be used for masking in a case where the position of the destination user detected by the position detecting unit is within a predetermined area.

According to an aspect of the present technology, surrounding sound is detected at a timing at which a notification to a destination user occurs, and a position of the destination user and positions of users other than the destination user is detected at the timing at which the notification occurs. Output of the notification to the destination user is controlled at a timing at which it is determined that the surrounding sound detected is masking possible sound which can be used for masking in a case where the position of the destination user detected is within a predetermined area.

Effects of the Invention

According to the present disclosure, it is possible to process signals. Particularly, it is possible to naturally create a state in which privacy is protected.

MODE FOR CARRYING OUT THE INVENTION

Figure 1:
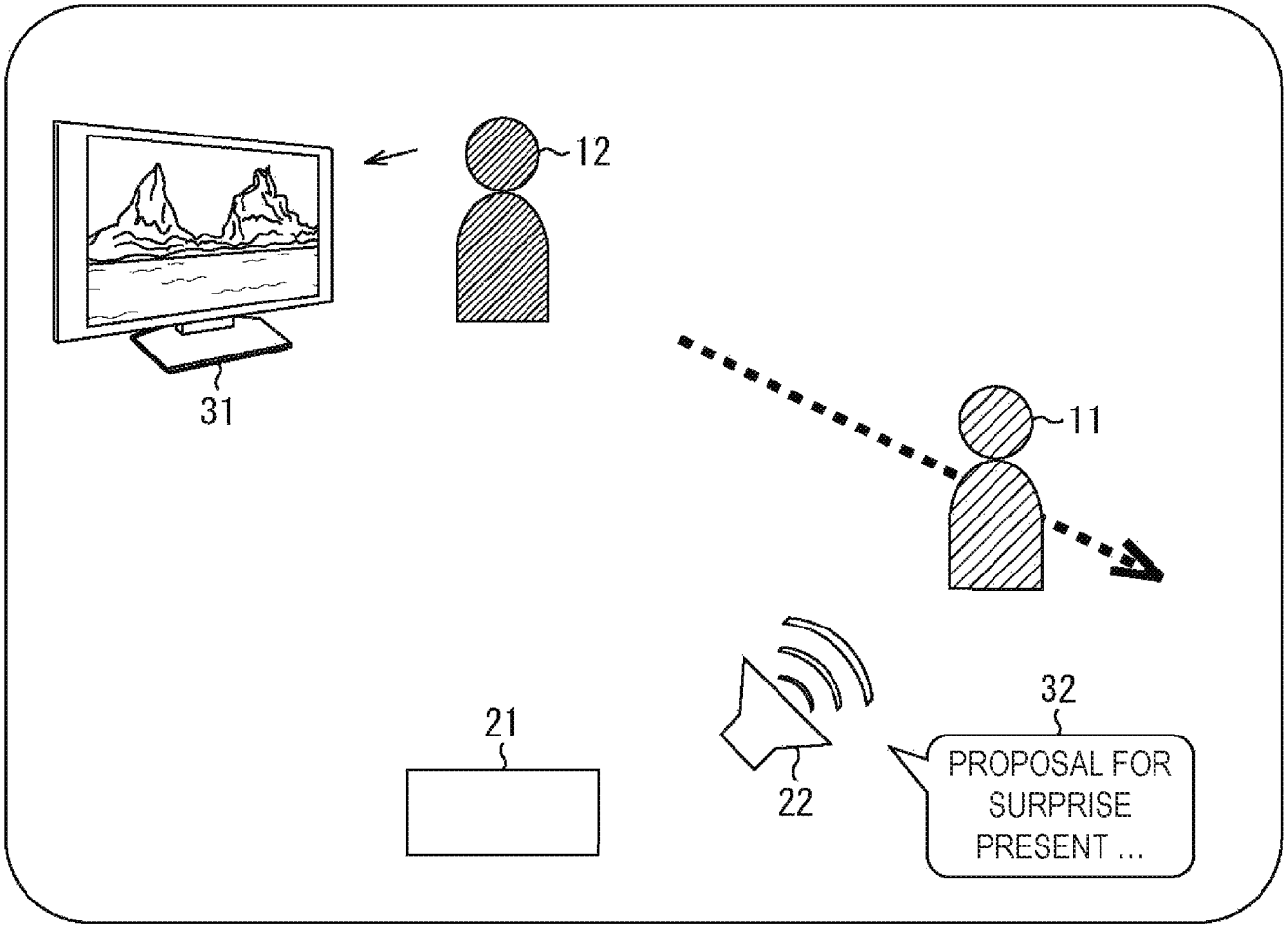
FIG. 1 is a diagram explaining operation of an individual notification system to which the present technology is applied.

Exemplary embodiments for implementing the present disclosure (which will be referred to as embodiments below) will be described below.

Operation of an individual notification system to which the present technology is applied will be described first with reference to FIG. 1.

In an example in FIG. 1, the individual notification system includes an agent 21 and a speaker 22, and is a system in which a timing at which speech can be only heard by a person to whom it is desired to make a notification (which will be referred to as a destination user) by utilizing surrounding sound (hereinafter, referred to as surrounding sound) is detected, and the agent 21 emits speech.

Here, utilizing the surrounding sound means, for example, estimation of a state where speech cannot be heard by using surrounding speech (such as conversation by a plurality of persons other than the destination user and romp of children), an air purifier, an air conditioner, piano sound, surrounding vehicle sound, or the like.

The agent 21, which is a signal processing apparatus to which the present technology is applied, is a physical agent like a robot or a software agent, or the like, installed in stationary equipment such as a smartphone and a personal computer or dedicated equipment.

The speaker 22 is connected to the agent 21 through wireless communication, or the like, and outputs speech by an instruction from the agent 21.

The agent 21 has, for example, a notification to be made to the user 11. In this event, the agent 21 in FIG. 1 recognizes that a user (for example, a user 12) other than the user 11 listens to a program of a television apparatus 31 located at a position distant from the speaker 22 (a position where a notification of speech cannot be made) by detecting sound from the television apparatus 31 and a location of the user 12. Then, at a timing at which sound is emitted from the television apparatus 31, the agent 21 outputs a notification 32 of "a proposal for a surprise present . . . " from the speaker 22 when it is detected that the user 11 moves to an area where a notification of speech from the speaker 22 can be made as indicated with an arrow.

Figure 2:
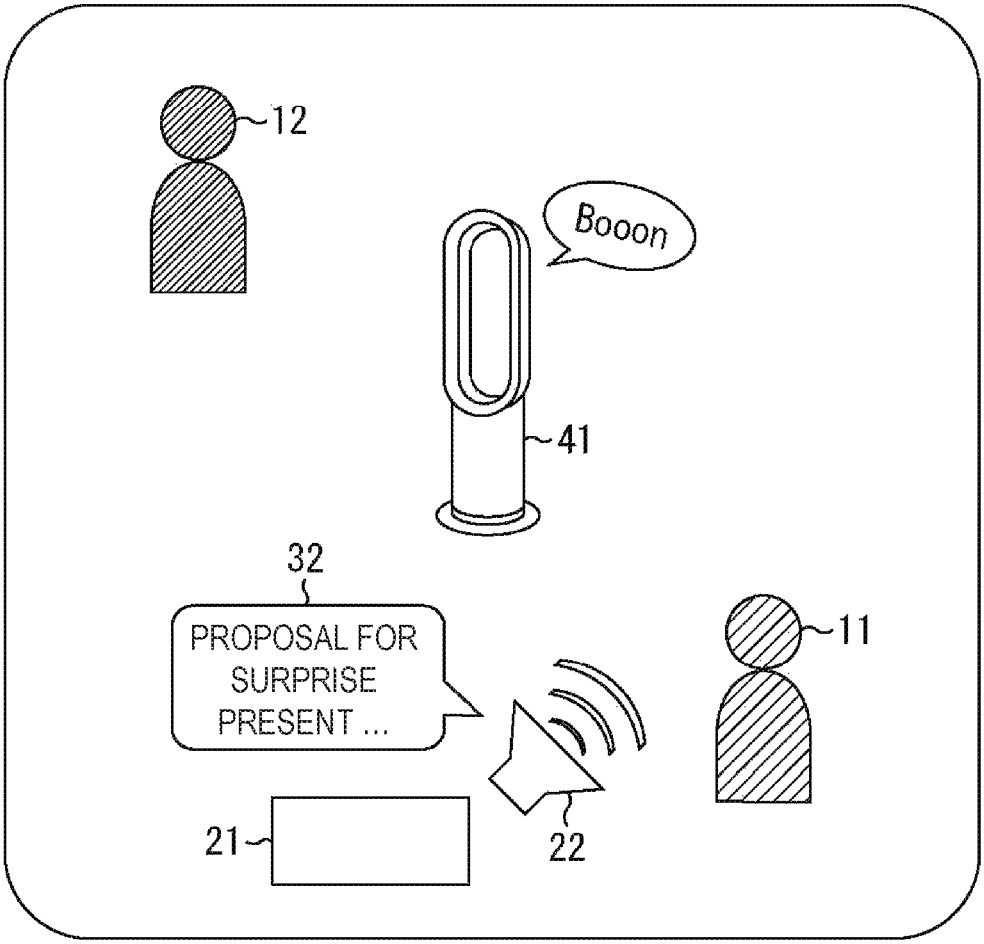
FIG. 2 is a diagram explaining another operation of the individual notification system to which the present technology is applied.

Further, the individual notification system also operates as illustrated in FIG. 2. FIG. 2 is a diagram explaining another operation of the individual notification system to which the present technology is applied.

The agent 21 has a notification to be made to the user 11 in a similar manner to a case of FIG. 1. In this event, the agent 21 in FIG. 2 recognizes that the user 12 is located at a position distant from the speaker 22 (a position where a notification of speech cannot be made) and noise is emitted from an electric fan 41 at a position of the user 12 and a position of the speaker 22 by detecting sound (noise) of Booon from the electric fan 41 and a position of a user (for example, the user 12) other than the user 11. Further, the agent 21 outputs a notification 32 of "a proposal for a surprise present . . . " from the speaker 22 when it is confirmed that the user 11 is located in an area where a notification of speech from the speaker 22 can be made.

As described above, in the individual notification system in FIG. 1 and FIG. 2, because speech is emitted to a person located near the agent 21 in a situation where sound of a level equal to or higher than a fixed level is emitted such as a situation where sound is emitted from the television apparatus 31, and a situation where children starts to romp, it is possible to make a notification only to the user 11 so that the speech is not heard by the user 12. By this means, it is possible to naturally create a state in which privacy is protected.

Note that, other than this method, it is also possible to predict a period during which detected interference sound continues, for example, predict that frying may be almost over, or a television program seems to end, and emit speech of an alarm or send visual feedback.

Figure 3:
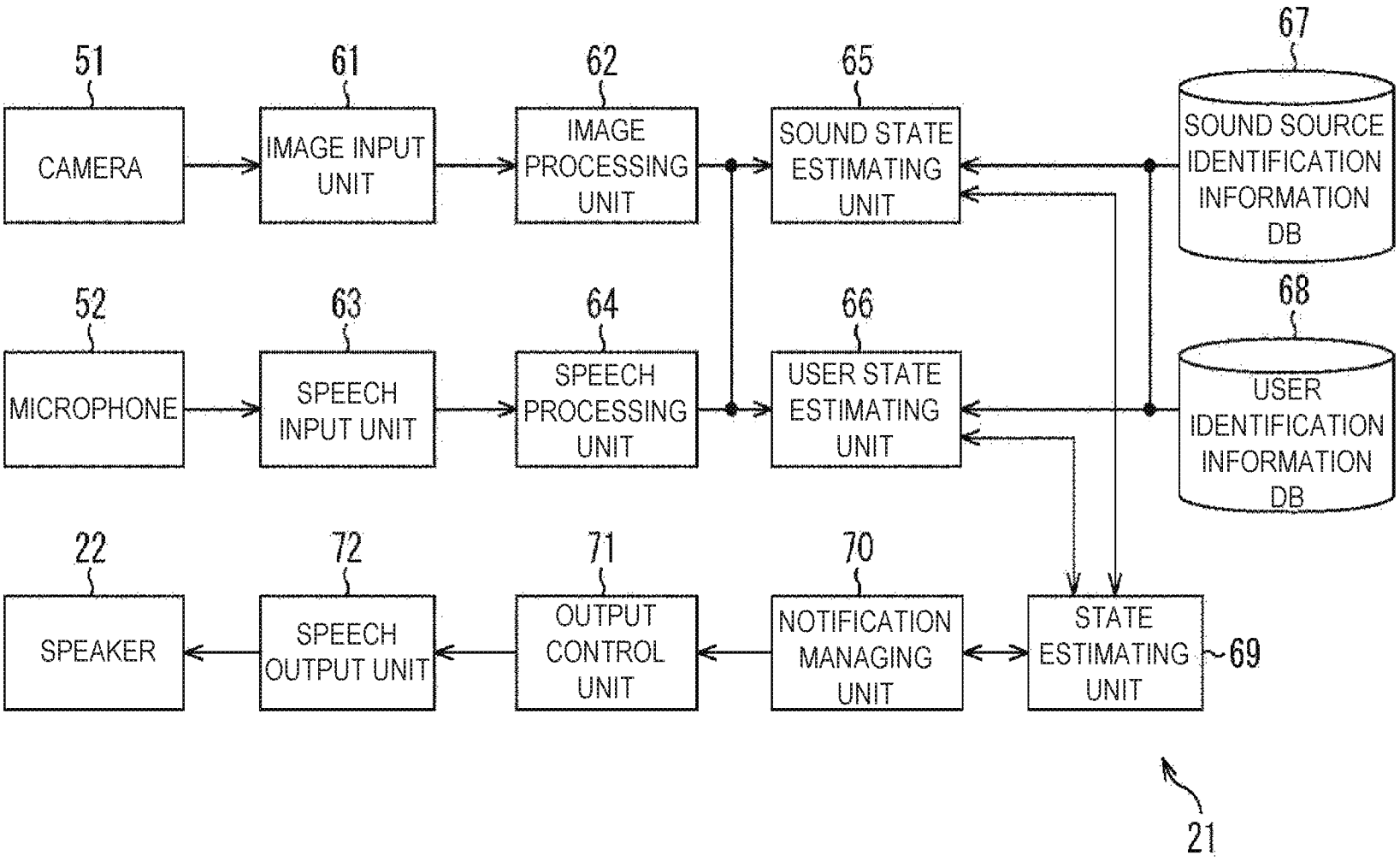
FIG. 3 is a block diagram illustrating a configuration example of an agent.

FIG. 3 is a block diagram illustrating a configuration example of the agent in FIG. 1.

In an example in FIG. 3, in addition to the speaker 22, a camera 51 and a microphone 52 are connected to the agent 21. The agent 21 includes an image input unit 61, an image processing unit 62, a speech input unit 63, a speech processing unit 64, a sound state estimating unit 65, a user state estimating unit 66, a sound source identification information DB 67, a user identification information DB 68, a state estimating unit 69, a notification managing unit 70, and an output control unit 71.

The camera 51 inputs a captured image of a subject to the image input unit 61. As described above, the microphone 52 collects surrounding sound such as sound of the television apparatus 31, the electric fan 41, or the like, and speech of the users 11 and 12 and inputs the collected surrounding sound to the speech input unit 63.

The image input unit 61 supplies the image from the camera 51 to the image processing unit 62. The image processing unit 62 performs predetermined image processing on the supplied image and supplies the image subjected to the image processing to the sound state estimating unit 65 and the user state estimating unit 66.

The speech input unit 63 supplies the surrounding sound from the microphone 52 to the speech processing unit 64. The speech processing unit 64 performs predetermined speech processing on the supplied sound and supplies the sound subjected to the speech processing to the sound state estimating unit 65 and the user state estimating unit 66.

The sound state estimating unit 65 detects masking material sound such as, for example, stationary sound emitted from equipment such as an air purifier and an air conditioner in the room, sound which is non-periodically emitted from equipment such as a television and a piano in the room, speech emitted from a person and an animal, and an environmental sound entering from outside of the room such as surrounding vehicle sound from the image from the image processing unit 62 and the sound from the speech processing unit 64 with reference to information in the sound source identification information DB 67 and supplies a detection result to the state estimating unit 69. Further, the sound state estimating unit 65 estimates whether the detected masking material sound continues and supplies an estimation result to the state estimating unit 69.

The user state estimating unit 66 detects positions of all the users such as a destination user and a user other than the destination user from the image from the image processing unit 62 and the sound from the speech processing unit 64 with reference to information in the user identification information DB 68 and supplies a detection result to the state estimating unit 69.

Further, the user state estimating unit 66 detects movement of all the users and supplies a detection result to the state estimating unit 69. In this event, a position is predicted for each of the users while movement trajectory is taken into account.

In the sound source identification information DB 67, a frequency, a duration and volume characteristics for each sound source, and appearance frequency information for each time slot are stored. In the user identification information DB 68, user preference, a user behavior pattern of one day (such as a location where speech can be easily conveyed to the user and a location to which the user frequently visits) are stored as user information. The user state estimating unit 66 can predict original behavior of the user with reference to this user identification information DB 68 and can present information so as not to inhibit the original behavior of the user. Setting of a notification possible area may be also performed with reference to the user identification information DB 68.

The state estimating unit 69 determines whether or not the detected material sound can serve as masking with respect to users other than the destination user in accordance with the material sound and positions of the respective users on the basis of the detection result and the estimation result from the sound state estimating unit 65 and the detection result from the user state estimating unit 66, and, in a case where the material sound can serve as masking, causes the notification managing unit 70 to make a notification to the destination user.

The notification managing unit 70 manages a notification, that is, a message, or the like, for which a notification is required to be made, and in a case where a notification has occurred, notifies the state estimating unit 69 that the notification has occurred and causes the state estimating unit 69 to estimate a state. Further, the notification managing unit 70 causes the output control unit 71 to output the message at a timing controlled by the state estimating unit 69.

The output control unit 71 causes the speech output unit 72 to output the message under control by the notification managing unit 70. For example, the output control unit 71 may cause the speech output unit 72 to make a notification, for example, with a volume similar to that of the masking material sound (quality of voice of a person who emits speech on television) or with sound quality and a volume which is less prominent than those of the masking material sound (persons who have a conversation around the user)

Further, it is also possible to send a message with sound in a frequency band in which sound can be heard by only users other than the destination user by utilizing a frequency in which sound is difficult to hear. For example, it is possible to make a situation where a message cannot be heard by young people with mosquito sound by generating a message using mosquito sound as masking material sound. For example, in a case where masking is not possible with the detected material sound or material sound is not detected, mosquito sound may be used. Note that, while a frequency in which sound is difficult to hear is used, it is also possible to utilize sound which is difficult to hear such as sound quality which is difficult to hear, other than the frequency.

The speech output unit 72 outputs a message with predetermined sound under control by the output control unit 71.

Note that, while a configuration example is illustrated in an example in FIG. 3 where only sound is used to make a notification of a message, it is also possible to employ a configuration where a display unit is provided in the individual notification system, and a display control unit is provided at the agent so as to make a visual notification and make a visual and auditory notification.

Individual notification signal processing of the individual notification system will be described next with reference to a flowchart in FIG. 4.

In step S51, the notification managing unit 70 stands by until it is determined that a notification to the destination has occurred. In step S51, in the case where it is determined that a notification has occurred, the notification managing unit 70 supplies a signal indicating that the notification has occurred to the state estimating unit 69, and the processing proceeds to step S52.

In step S52, the sound state estimating unit 65 and the user state estimating unit 66 perform state estimation processing under control by the state estimating unit 69. While this state estimation processing will be described later with reference to FIG. 5, a detection result of material sound and a detection result of a user state are supplied to the state estimating unit 69 through the state estimation processing in step S52. Note that detection of the material sound and detection of the user state may be performed at the same timing at which the notification has occurred, or may be performed at timings which are not completely the same and are somewhat different.

In step S53, the state estimating unit 69 determines whether or not masking is possible with the material sound on the basis of the detection result of the material sound and the detection result of the user state. That is, it is determined whether a notification can be made only to the destination user by masking being performed with the material sound. In step S53, in the case where it is determined that masking is not possible, the processing returns to step S52, and the processing in step S52 and subsequent steps is repeated.

In step S53, in the case where it is determined that masking is possible, the processing proceeds to step S54. In step S54, the notification managing unit 70 causes the output control unit 71 to execute a notification at a timing controlled by the state estimating unit 69 and output a message from the speaker 22.

The state estimation processing in step S52 in FIG. 4 will be described next with reference to a flowchart in FIG. 5.

The camera 51 inputs a captured image of a subject to the image input unit 61. As described above, the microphone 52 collects surrounding sound such as sound of the television apparatus 31, the electric fan 41, or the like, and speech of the user 11 and the user 12 and inputs the collected surrounding sound to the speech input unit 63.

The image input unit 61 supplies the image from the camera 51 to the image processing unit 62. The image processing unit 62 performs predetermined image processing on the supplied image and supplies the image subjected to the image processing to the sound state estimating unit 65 and the user state estimating unit 66.

In step S71, the user state estimating unit 66 detects a position of the user. That is, the user state estimating unit 66 detects positions of all users such as the destination user and users other than the destination user from the image from the image processing unit 62 and the sound from the speech processing unit 64 with reference to information in the user identification information DB 68, and supplies a detection result to the state estimating unit 69.

In step S72, the user state estimating unit 66 detects movement of all the users and supplies a detection result to the state estimating unit 69.

In step S73, the sound state estimating unit 65 detects masking material sound such as sound of an air purifier, an air conditioner, a television, or a piano, and surrounding vehicle sound from the image from the image processing unit 62 and the sound from the speech processing unit 64 with reference to information in the sound source identification information DB 67 and supplies a detection result to the state estimating unit 69.

In step S74, the sound state estimating unit 65 estimates whether the detected masking material sound continues and supplies an estimation result to the state estimating unit 69.

Figure 4:
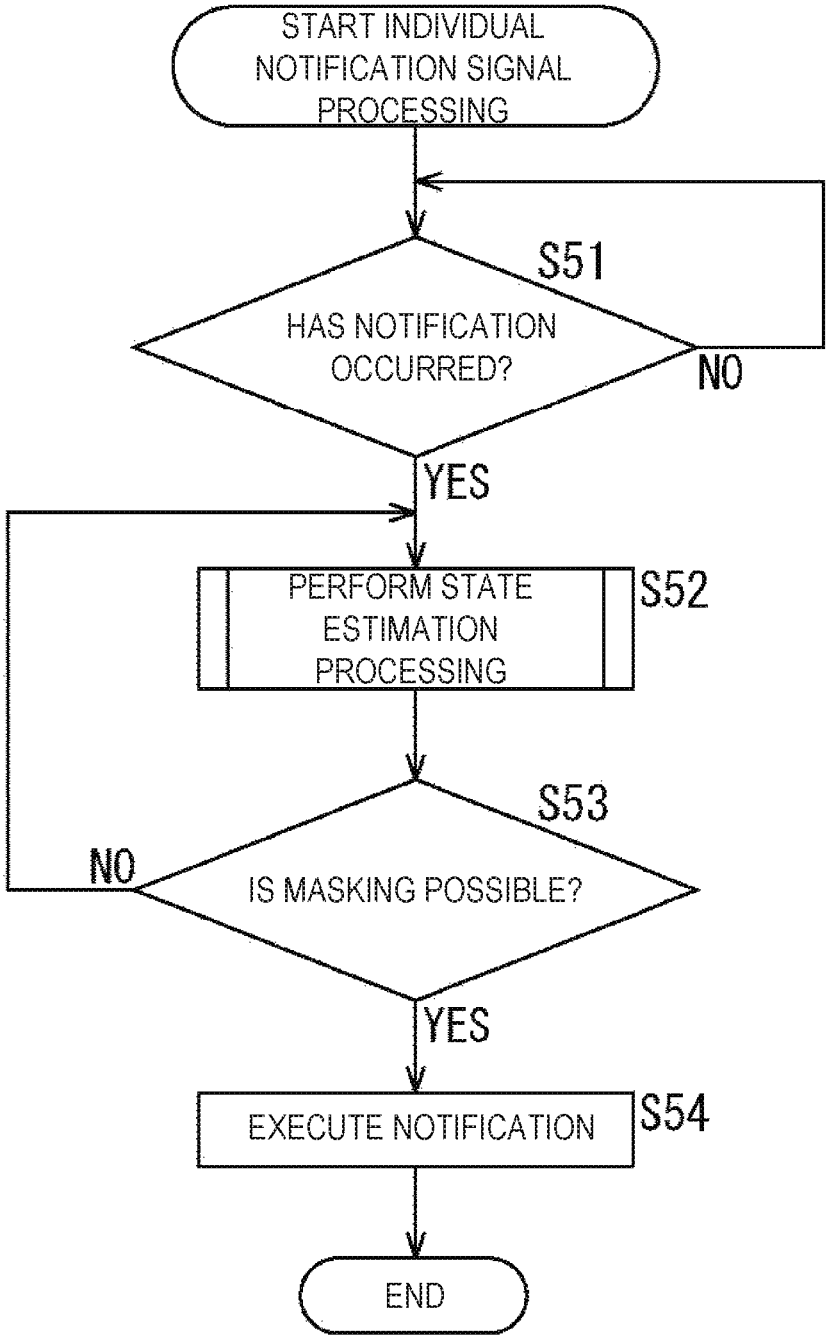
FIG. 4 is a flowchart explaining individual notification signal processing.
Figure 5:
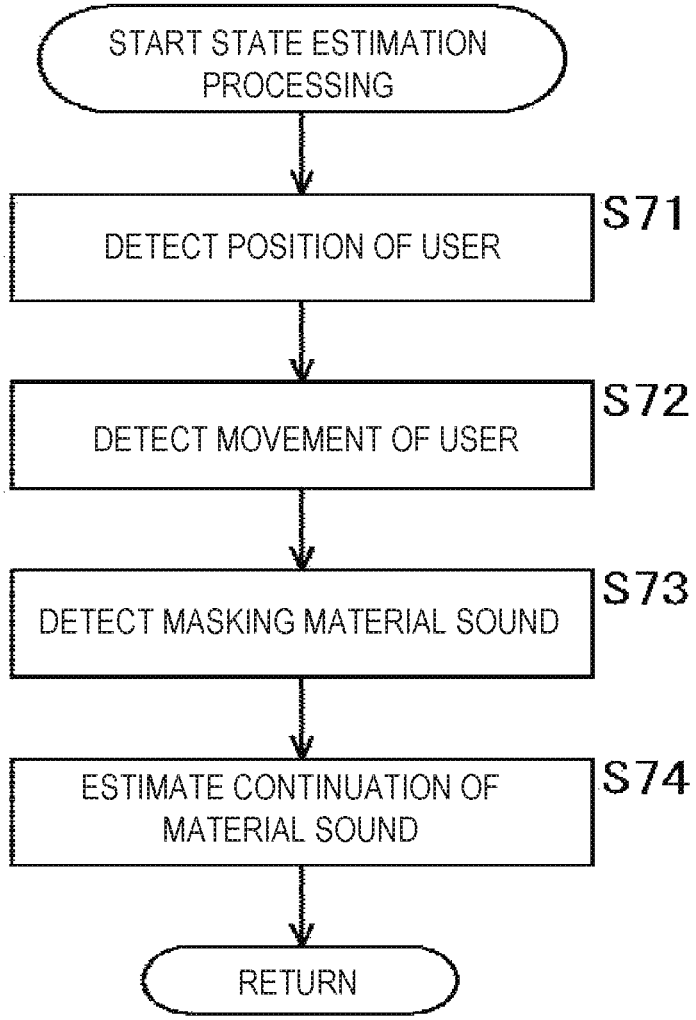
FIG. 5 is a flowchart explaining state estimation processing in step S52 in FIG. 4.

Thereafter, the processing returns to step S52 in FIG. 4, and proceeds to step S53. Then, in step S53, it is determined whether or not masking is possible with the material sound on the basis of a detection result of the material sound and a detection result of the user state.

By the processing as described above, it is possible to cause a message to be output so as to be heard only by the destination user. That is, it is possible to naturally create a state in which privacy is protected.

Note that, while, in the above description, an example has been described where a message is prevented from being heard by users other than the destination user by utilizing masking material sound, it is also possible to prevent a message from being heard by users other than the destination user by utilizing a situation where attention is not given.

The situation where "attention is not given" is, for example, a situation where users other than the destination user focus on something (such as a television program and work) and cannot hear sound, for example, a situation where users other than the destination user fall asleep (a state is detected, and a notification is executed in a case where persons to whom it is not desired to convey a message seem unlikely to hear the message).

Further, for example, it is also possible to reproduce content such as music in which users other than the destination user have interest, and news to the users other than the destination user using a function of automatically reproducing content, or the like, and present information which is desired to be made secret, to the destination user during this period.

Note that, in a case where it is impossible to output a message so as to be heard only by the destination user, it is also possible to notify the destination user of only information indicating that there is a notification, present the information at a display unit of a terminal of the destination, or guide the destination user to a location where there is no user other than the destination user, such as a hallway and a bathroom.

Further, as a method for confirmation after a message is output so as to be heard only by the destination user, it is also possible to give feedback to a provider of the notification that information has been presented to the destination user located in public space. It is also possible to give feedback that the destination user has confirmed content of the information. A method for feedback may be gesture. This feedback is given by, for example, the notification managing unit 70, or the like.

Further, a multimodal may be used. That is, it is also possible to employ a configuration where sound, visual sense, tactile sense, or the like, are combined, and content cannot be conveyed with sound alone or visual sense alone, so that content of information is conveyed by combination of the both.

<Computer>

The series of processes described above can be executed by hardware, and can also be executed in software. In the case of executing the series of processes by software, a program forming the software is installed on a computer. Herein, the term computer includes a computer built into special-purpose hardware, a computer able to execute various functions by installing various programs thereon, such as a general-purpose personal computer, for example, and the like.

Figure 6:
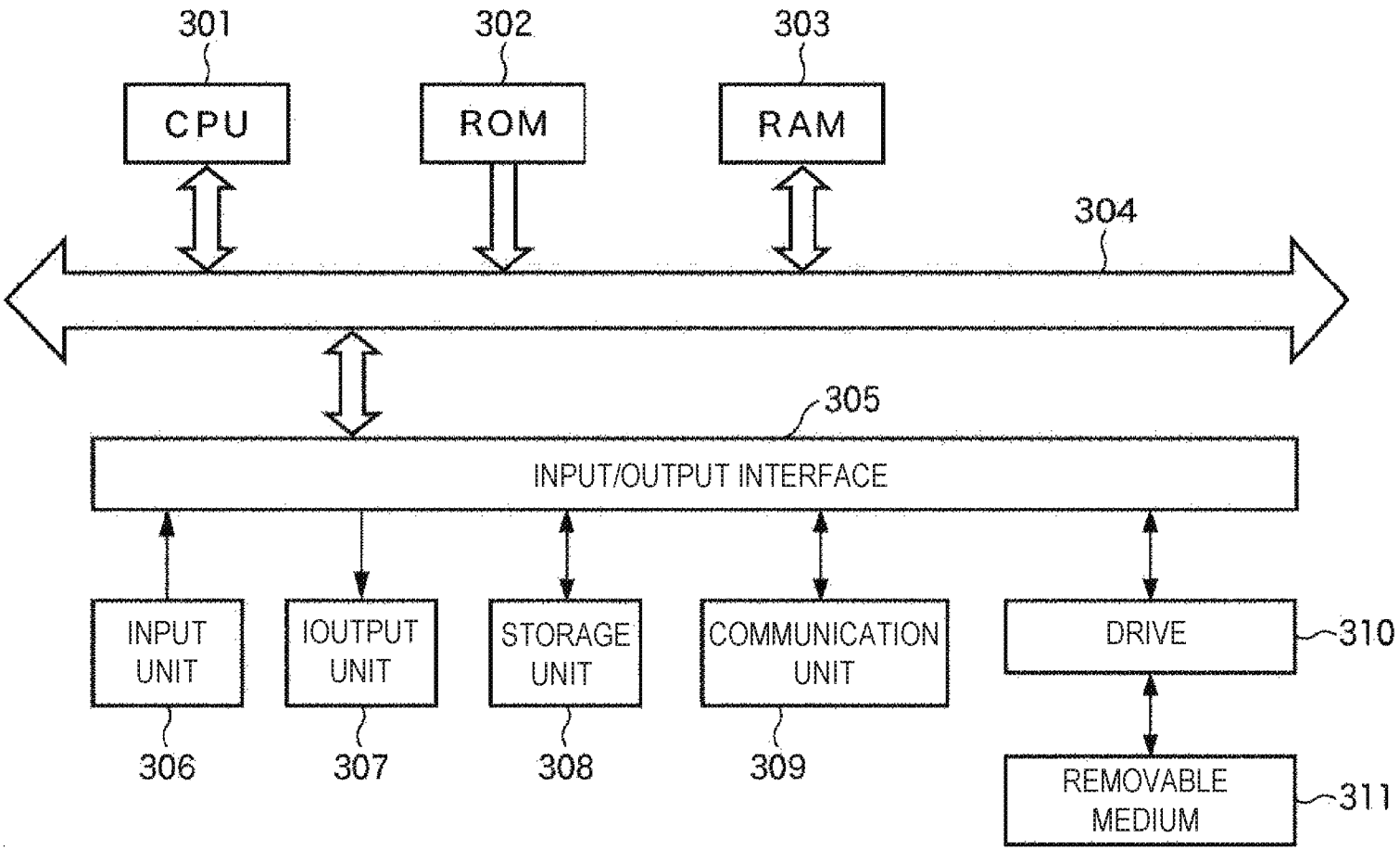
FIG. 6 is a block diagram illustrating an example of main components of a computer.

FIG. 6 is a block diagram illustrating an exemplary hardware configuration of a computer that executes the series of processes described above according to a program.

In the computer illustrated in FIG. 6, a central processing unit (CPU) 301, read-only memory (ROM) 302, and random access memory (RAM) 303 are interconnected through a bus 304.

Additionally, an input/output interface 305 is also connected to the bus 304. An input unit 306, an output unit 307, a storage unit 308, a communication unit 309, and a drive 310 are connected to the input/output interface 305.

The input unit 306 includes a keyboard, a mouse, a microphone, a touch panel, an input terminal, and the like, for example. The output unit 307 includes a display, a speaker, an output terminal, and the like, for example. The storage unit 308 includes a hard disk, a RAM disk, nonvolatile memory, and the like, for example. The communication unit 309 includes a network interface, for example. The drive 310 drives a removable medium 311 such as a magnetic disk, an optical disc, a magneto-optical disc, or semiconductor memory.

In a computer configured as above, the series of processes described above is performed by having the CPU 301 load a program stored in the storage unit 308 into the RAM 303 via the input/output interface 305 and the bus 304, and execute the program, for example.

Additionally, data required for the CPU 301 to execute various processes and the like is also stored in the RAM 303 as appropriate.

The program executed by the computer (CPU 301) may be applied by being recorded onto the removable medium 311 as an instance of packaged media or the like, for example. In this case, the program may be installed in the storage unit 308 via the input/output interface 310 by inserting the removable medium 311 into the drive 310.

In addition, the program may also be provided via a wired or wireless transmission medium such as a local area network, the Internet, or digital satellite broadcasting. In this case, the program may be received by the communication unit 309 and installed in the storage unit 308.

Otherwise, the program may also be preinstalled in the ROM 302 or the storage unit 308.

Furthermore, an embodiment of the present technology is not limited to the embodiments described above, and various changes and modifications may be made without departing from the scope of the present technology.

For example, in this specification, a system means a set of a plurality of constituent elements (e.g., devices or modules (parts)), regardless of whether or not all the constituent elements are in the same housing. Accordingly, a plurality of devices that is contained in different housings and connected via a network and one device in which a plurality of modules is contained in one housing are both systems.

Furthermore, for example, an element described as a single device (or processing unit) may be divided and configured as a plurality of devices (or processing units). Conversely, elements described as a plurality of devices (or processing units) above may be configured collectively as a single device (or processing unit). Furthermore, an element other than those described above may be added to the configuration of each device (or processing unit). Furthermore, a part of the configuration of a given device (or processing unit) may be included in the configuration of another device (or another processing unit) as long as the configuration or operation of the system as a whole is substantially the same.

Furthermore, for example, the present technology can adopt a configuration of cloud computing which performs processing by allocating and sharing one function by a plurality of devices through a network.

Furthermore, for example, the program described above can be executed in any device. In this case, it is sufficient if the device has a necessary function (functional block or the like) and can obtain necessary information.

Furthermore, for example, each step described by the above-described flowcharts can be executed by one device or executed by being allocated to a plurality of devices. Moreover, in the case where a plurality of processes is included in one step, the plurality of processes included in this one step can be executed by one device or executed by being allocated to a plurality of devices.

Note that in a program executed by a computer, processing in steps describing the program may be executed chronologically along the order described in this specification, or may be executed concurrently, or individually at necessary timing such as when a call is made. Moreover, processing in steps describing the program may be executed concurrently with processing of another program, or may be executed in combination with processing of another program.

Note that the plurality of present technologies described in this specification can be performed alone independently of each other, unless a contradiction arises. Of course, any plurality of the present technologies can be performed in combination. In one example, the present technology described in any of the embodiments can be performed in combination with the present technology described in another embodiment. Furthermore, any of the present technologies described above can be performed in combination with another technology that is not described above.

Additionally, the present technology may also be configured as below.

(1) A signal processing apparatus including:

a sound detecting unit configured to detect surrounding sound at a timing at which a notification to a destination user occurs;

a position detecting unit configured to detect a position of the destination user and positions of users other than the destination user at the timing at which the notification occurs; and an output control unit configured to control output of the notification to the destination user at a timing at which it is determined that the surrounding sound detected by the sound detecting unit is masking possible sound which can be used for masking in a case where the position of the destination user detected by the position detecting unit is within a predetermined area.

(2) The signal processing apparatus according to (1), further including:

a movement detecting unit configured to detect movement of the destination user and the users other than the destination user, in which, in a case where movement is detected by the movement detecting unit, the position detecting unit also detects a position of the destination user and positions of the users other than the destination user to be estimated through movement detected by the movement detecting unit.

(3) The signal processing apparatus according to (1) or (2), further including:

a duration predicting unit configured to predict a duration while the masking possible sound continues, in which the output control unit controls output of information indicating that the duration while the masking possible sound continues, predicted by the duration predicting unit, ends.

(4) The signal processing apparatus according to any one of (1) to (3), in which the surrounding sound is stationary sound emitted from equipment in a room, sound non-periodically emitted from equipment in the room, speech emitted from a person or an animal, or environmental sound entering from outside of the room.

(5) The signal processing apparatus according to any one of (1) to (4), in which, in a case where it is determined that the surrounding sound detected by the sound detecting unit is not masking possible sound which can be used for masking, in a case where the position of the destination user detected by the position detecting unit is within the predetermined area, the output control unit controls output of the notification to the destination user along with sound in a frequency band which can be heard only by the users other than the destination user.

(6) The signal processing apparatus according to any one of (1) to (5), in which the output control unit controls output of the notification to the destination user with sound quality which is similar to sound quality of the surrounding sound detected by the sound detecting unit.

(7) The signal processing apparatus according to any one of (1) to (6), in which the output control unit controls output of the notification to the destination user in a case where the positions of the users other than the destination user detected by the position detecting unit are not within the predetermined area.

(8) The signal processing apparatus according to any one of (1) to (6), in which the output control unit controls output of the notification to the destination user in a case where it is detected that the users other than the destination user detected by the position detecting unit are put into a sleep state.

(9) The signal processing apparatus according to any one of (1) to (6), in which the output control unit controls output of the notification to the destination user in a case where the users other than the destination user detected by the position detecting unit focus on a predetermined thing.

(10) The signal processing apparatus according to any one of (1) to (9), in which the predetermined area is an area where the destination user often exists.

(11) The signal processing apparatus according to any one of (1) to (10), in which, in a case where it is not determined that the surrounding sound detected by the sound detecting unit is masking possible sound which can be used for masking, or in a case where the position of the destination user detected by the position detecting unit is not within the predetermined area, the output control unit notifies the destination user that there is a notification.

(12) The signal processing apparatus according to any one of (1) to (11), further including:

a feedback unit configured to give feedback that the notification to the destination user has been made to an issuer of the notification to the destination user.

(13) A signal processing method executed by a signal processing apparatus, the method including:

detecting surrounding sound at a timing at which a notification to a destination user occurs;

detecting a position of the destination user and positions of users other than the destination user at a timing at which the notification to the destination user occurs; and controlling output of the notification to the destination user at a timing at which it is determined that the surrounding sound detected by the sound detecting unit is masking possible sound which can be used for masking in a case where the position of the destination user detected by the position detecting unit is within a predetermined area.

(14) A program for causing a computer to function as:

a sound detecting unit configured to detect surrounding sound at a timing at which a notification to a destination user occurs;

a position detecting unit configured to detect a position of the destination user and positions of users other than the destination user at the timing at which the notification occurs; and an output control unit configured to control output of the notification to the destination user at a timing at which it is determined that the surrounding sound detected by the sound detecting unit is masking possible sound which can be used for masking in a case where the position of the destination user detected by the position detecting unit is within a predetermined area.

REFERENCE SIGNS LIST

21 Agent
22 Speaker
31 Television apparatus
32 Notification
41 Electric fan
51 Camera
52 Microphone
61 Image input unit
62 Image processing unit
63 Speech input unit
64 Speech processing unit
65 Sound state estimating unit
66 User state estimating unit
67 Sound source identification information DB
68 User identification information DB
69 State estimating unit
70 Notification managing unit
71 Output control unit
72 Speech output unit

The invention claimed is:

1. A signal processing apparatus comprising:

circuitry configured to:

detect surrounding sound at a timing at which a notification to a destination user occurs;

detect a position of the destination user and positions of users other than the destination user at the timing at which the notification occurs;

control output of the notification to the destination user at a timing at which determination is made that the detected surrounding sound is possible masking sound which can be used for masking in a case where the detected position of the destination user is within a predetermined area; and control output of the notification to the destination user in a case where the positions of the users other than the destination user detected by the circuitry are not within the predetermined area.

2. The signal processing apparatus according to claim 1, wherein the circuitry is configured to detect movement of the destination user and the users other than the destination user, wherein, in a case where movement is detected by the circuity, the circuitry also detects a position of the destination user and positions of the users other than the destination user to be estimated through movement detected by the circuitry.

3. The signal processing apparatus according to claim 1, wherein the circuitry is:

configured to predict a duration while the possible masking sound continues, and configured to control output of information indicating an end of the duration while the masking possible sound continues.

4. The signal processing apparatus according to claim 1, wherein the surrounding sound is stationary sound emitted from equipment in a room, sound non-periodically emitted from equipment in the room, speech emitted from a person or an animal, or environmental sound entering from outside of the room.

5. The signal processing apparatus according to claim 1, wherein, in a case where a determination is made that the surrounding sound detected by the circuitry is not masking possible sound which can be used for masking, and in a case where the position of the destination user detected by the circuitry is within the predetermined area, the circuitry controls output of the notification to the destination user along sound with sound quality which can be heard only by the users other than the destination user.

6. The signal processing apparatus according to claim 1, wherein the circuitry controls output of the notification to the destination user with sound quality which is similar to sound quality of the surrounding sound detected by the circuitry.

7. The signal processing apparatus according to claim 1, wherein the circuitry controls output of the notification to the destination user in a case where detection is made that the users other than the destination user detected by the circuitry are put into a sleep state.

8. The signal processing apparatus according to claim 1, wherein the circuitry controls output of the notification to the destination user in a case where the users other than the destination user detected by the circuitry focus on a predetermined thing.

9. The signal processing apparatus according to claim 1, wherein the predetermined area is an area where the destination user often exists.

10. The signal processing apparatus according to claim 1, wherein, in a case where a determination is not made that the surrounding sound detected by the circuitry is masking possible sound which can be used for masking, or in a case where the position of the destination user detected by the circuitry is not within the predetermined area, the circuitry notifies the destination user that there is a notification.

11. The signal processing apparatus according to claim 1, wherein the circuitry is configured to give feedback that the notification to the destination user has been made to an issuer of the notification to the destination user.

12. A signal processing method executed by a signal processing apparatus, the method comprising:

detecting surrounding sound in a case where there is a notification to a destination user;

detecting a position of the destination user and positions of users other than the destination user;

controlling output of the notification to the destination user at a timing at which determination is made that the detected surrounding sound is masking possible sound which can be used for masking in a case where the position of the destination user detected by the position detecting unit is within a predetermined area; and controlling output of the notification to the destination user in a case where the positions of the users other than the destination user detected by the circuitry are not within the predetermined area.

13. A non-transitory computer-readable storage medium storing executable instruction which when executed by circuitry performs a method comprising:

detecting surrounding sound in a case where there is a notification to a destination user;

detecting a position of the destination user and positions of users other than the destination user;

controlling output of the notification to the destination user at a timing at which determination is made that the detected surrounding sound is masking possible sound which can be used for masking in a case where the position of the destination user detected by the position detecting unit is within a predetermined area; and controlling output of the notification to the destination user in a case where the positions of the users other than the destination user detected by the circuitry are not within the predetermined area.

* * * * *